US005218954A

United States Patent [19]

van Bemmelen

[11] Patent Number: 5,218,954

[45] Date of Patent: Jun. 15, 1993

[54] ARTERIAL ASSIST DEVICE AND METHOD

[76] Inventor: Paul S. van Bemmelen, 2012 Barberry, Springfield, Ill. 62704

[21] Appl. No.: 911,213

[22] Filed: Jul. 9, 1992

[51] Int. Cl.[5] ..... A61H 7/00

[52] U.S. Cl. ..... 128/24 R; 128/64; 128/DIG. 20; 602/13

[58] Field of Search ..... 128/64, DIG. 20, 24 R, 128/402; 602/13, 14

[56] References Cited

U.S. PATENT DOCUMENTS

| | | | |
|---|---|---|---|
| 2,842,655 | 7/1958 | Schwebel | 128/402 |
| 2,884,646 | 5/1959 | Alber | 128/DIG. 20 |
| 3,179,106 | 4/1965 | Meredith | 128/64 |
| 3,824,992 | 7/1974 | Nicholson et al. . | |
| 3,901,221 | 8/1975 | Nicholson et al. | 128/24 R |
| 4,153,050 | 5/1979 | Bishop et al. . | |
| 4,186,732 | 2/1980 | Christoffel . | |
| 4,370,975 | 2/1983 | Wright . | |
| 4,624,244 | 11/1986 | Taheri . | |
| 4,841,956 | 1/1989 | Gardner et al. | 128/64 |
| 4,858,596 | 8/1989 | Kolstedt et al. . | |
| 4,938,208 | 7/1990 | Dye | 128/DIG. 20 |
| 4,947,834 | 8/1990 | Kartheus et al. . | |
| 4,989,589 | 2/1991 | Pekanmäki | 128/24 R |
| 5,052,397 | 10/1991 | Frajdenrajch . | |
| 5,092,317 | 3/1992 | Zelikovski . | |

FOREIGN PATENT DOCUMENTS 0197710 10/1977 U.S.S.R. .

OTHER PUBLICATIONS

*Compensation of Arterial Insufficiency by Augmenting the Circulation with Intermittent Compression of the Limbs,* James P. Henry and Travis Winsor, American Heart Journal Jul. 1965.

*The Return of Blood to the Heart: Venous Pumps in Health and Disease,* A. M. N. Gardner and R. H. Fox 1989.

*Cardiosynchronous Limb Compression: Effects on Noninvasive Vascular Tests and Clinical Course of the Ischemic Limb,* Joel Steinberg, M. D., Ph.D., *Angiology—The Journal of Vascular Diseases, vol. 43, No. 6, Jun. 1992.*

*Primary Examiner*—Richard J. Apley
*Assistant Examiner*—Jeanne Mollo
*Attorney, Agent, or Firm*—Robbins & Robbins

[57] ABSTRACT

A device and method are provided the purpose of increasing arterial blood flow to the lower leg, calf, ankle and foot. The device is a compression boot, or cast, and consists of a mono-compartment bladder enclosed in a non-elastic outer envelope connected to an air compressor with regulator valve, providing fast inflation to pressures over 80 mm Hg, within 0.5 seconds. This high pressure compression phase is sustained for 2 seconds. Decompression occurs rapidly, within 0.5 seconds, by venting a large valve to the atmosphere. During the resulting low pressure phase (pressure 0–30 mm Hg), which lasts between 8–14 seconds, there is a marked increase in arterial blood flow.

13 Claims, 3 Drawing Sheets

ARTERIAL ASSIST DEVICE AND METHOD

BACKGROUND OF THE INVENTION

Improvement of the arterial blood flow, in patients with obstruction of the arteries to the leg, is usually obtained by surgically bypassing the occluded arteries, or by removing obstructions with devices that are inserted into the blood vessel. In elderly patients who have undergone multiple vascular procedures, the deterioration of arterial blood flow can lead to severe pain (ischemic neuritis), tissue loss (arterial ulcers) or toe loss (gangrene). When the arteries cannot be repaired anymore, this situation may lead to leg amputation. An external compression device is herein described that could improve arterial blood flow in order to treat ischemic pain and ulceration, and obviate the need for amputation, thereby eliminating the risks of surgery.

SUMMARY OF THE INVENTION

The object of the invention is to increase arterial blood flow from the heart towards the foot, in patients with arterial obstruction. This is achieved by simultaneous rapid compression of the soft tissues of the calf, ankle and foot, thereby completely and instantly emptying the veins, and reducing venous pressure to zero in a sitting patient position. Upon rapid deflation of the boot, the reduced venous pressure results in an increased driving pressure for the arterial blood flow. The increased arterial blood flow will occur approximately one second after deflation, and will last for approximately 4–14 seconds. The compression phase itself does not improve arterial flow, but impedes arterial flow; therefore compression is kept as short as possible. The design of the compression boot is fashioned for this purpose. A stiff, non-elastic outer case for the lower leg and foot reduces the amount of fluid (air) needed to inflate the relatively small bladder. The shape of the bladder provides a contiguous connection between the foot part and the calf part. The location of the bladder overlying the area between ankle bone and heel bone results in effective compression of the soft tissues in front of the Achilles tendon, which contain the veins draining the foot. Prior art devices did not concentrate pressure in the ankle area where it is very effective in order to increase arterial flow. Some prior devices, intended to promote massaging of body fluids, have flexible, that is adjustable, control of the peak pressure and duration of the pressure wave. Due to the slow nature of the inflation to plateau phase (generally ranging from 13 to 70 seconds with multiple juxtaposed cells), these devices impede arterial blood flow and are contra-indicated (as a number of instruction manuals mention) in patients with arterial disease. Past research also indicated that high pressure (over 70 mm Hg) applied for a short period of time (3–5 seconds) would increase arterial flow. However, such pressure was gradually reached over 3–5 seconds after the initiation of the inflation. The net increase in arterial flow, however, was negligible.

The present invention employs a rapid inflation and deflation pressure cycle, which exceeds 70 mm Hg upon inflation and gives an optimal effect on arterial blood flow. The higher pressure level and rapid inflation are essential elements of this invention. This pressure is needed as the venous pressure in the foot of a sitting subject reaches 70 mm Hg and dissipation of external pressure occurs in the deep tissues, which contain the veins draining the foot.

The above features are objects of this invention. Further objects will appear in the detailed description which follows and will be otherwise apparent to those skilled in the art.

For purpose of illustration of this invention a preferred embodiment is shown and described hereinbelow in the accompanying drawing. It is to be understood that this is for the purpose of example only and that the invention is not limited thereto.

IN THE DRAWINGS

DESCRIPTION OF THE INVENTION

Figures 1, 2:
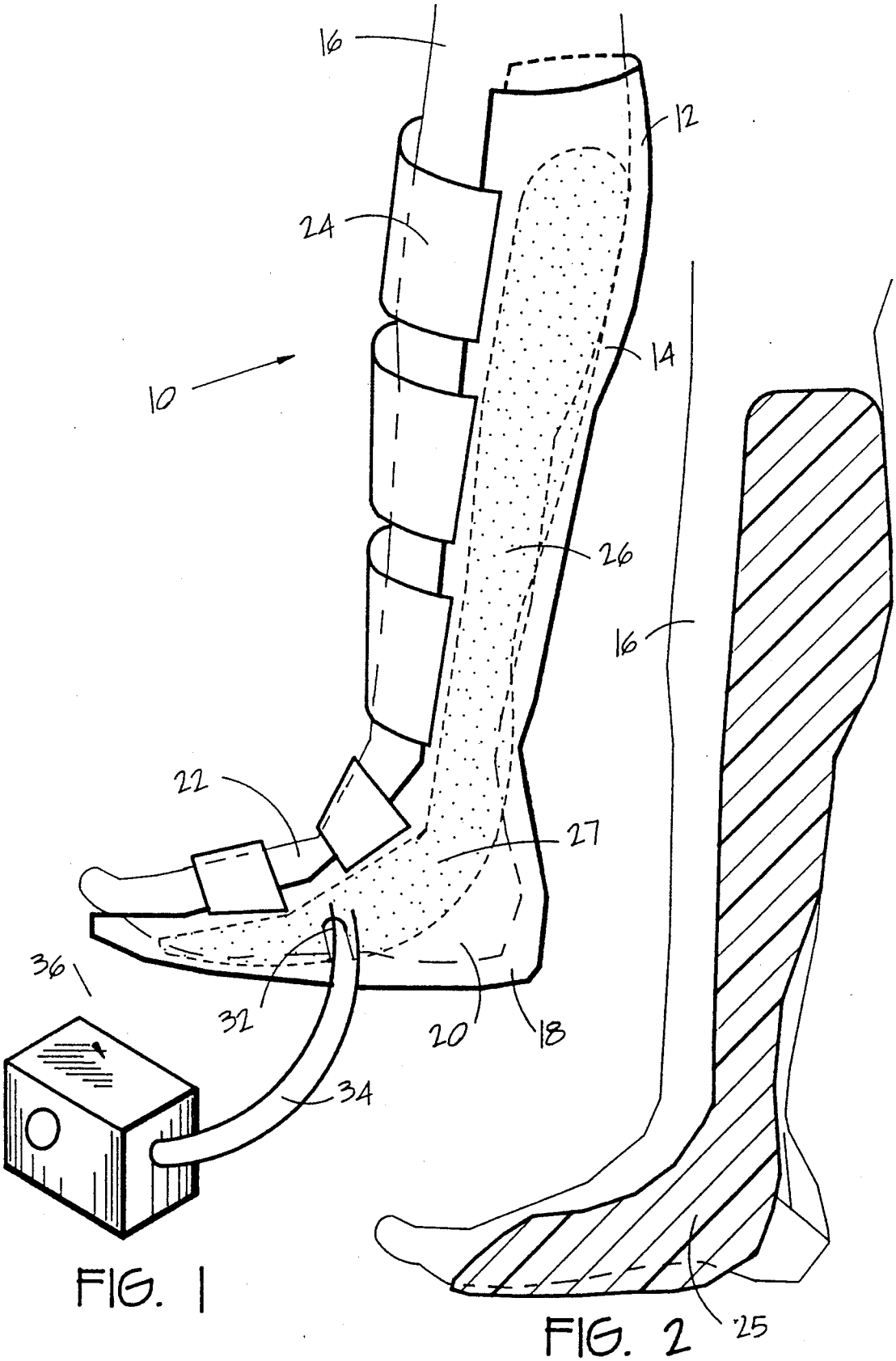
FIG. 1 is a side view of a compression boot in place on the leg of a sitting patient.
FIG. 2 is a side view of the medial aspect of the leg, with the pressure area indicated on the skin.

The compression boot of the invention is generally indicated by the reference numeral 10 as shown in FIG. 1. It is comprised of a rigid cast 12, made of polypropylene or the like. Cast 12 can be semi-rigid as well, so long as it constrains the inflatable bladder against the leg. Thus, flexible, non-stretching materials, such as leather or canvas can also be used to make up the cast. Cast 12 has an upper section 14 which receives the rear of a calf of a patient's leg 16, and a lower section 18 which receives the ankle 20 and foot 22. A plurality of straps 24 are provided to secure cast 12 about the leg as shown. Straps 24 can be equipped with Velcro®, snaps or other suitable fastening means.

Figure 5:
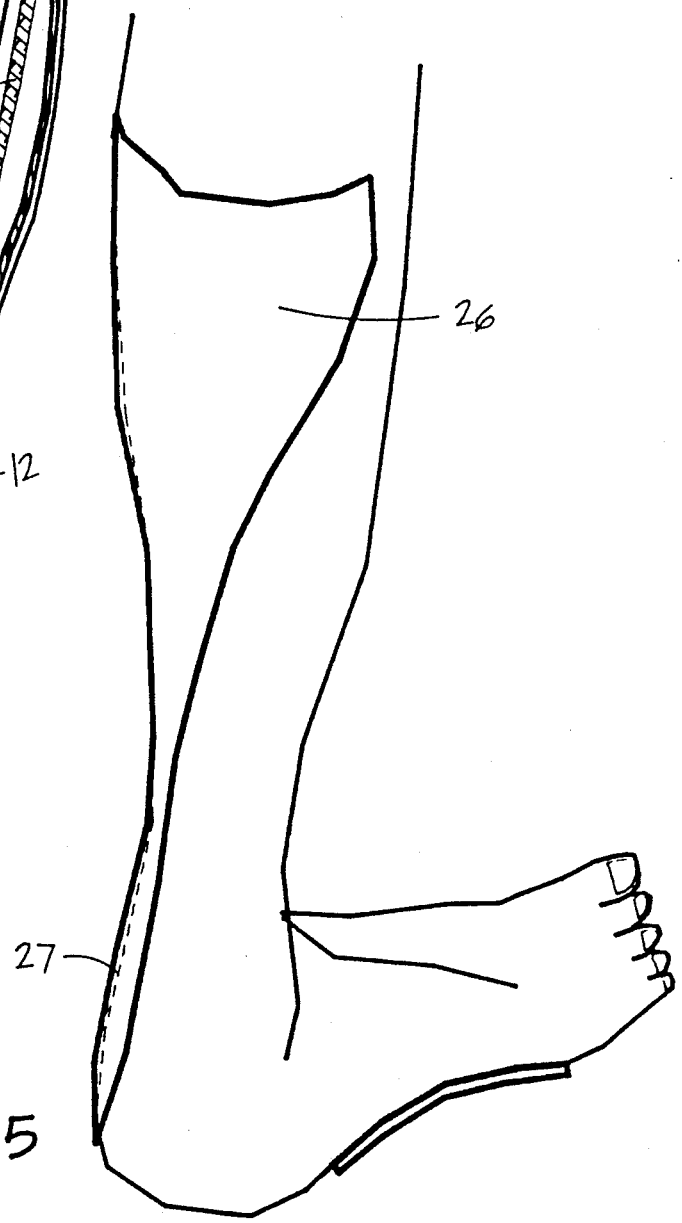
FIG. 5 is a perspective view from the rear of the lateral aspect of the leg, showing the positioning of the inflatable bladder on the leg.

An inflatable rubber bladder 26 is disposed within cast 12, and is held in position by glue, stitching or other appropriate means. The shape and positioning of bladder 26 is best shown in FIG. 5. FIG. 2 illustrates where bladder 26 is in contact with leg 16. The contact area consists of the region over the dorsal aspect of the calf, the region located behind the medial ankle bone (medial malleolus) and in front of the heel bone (calcaneus) and Achilles tendon, and the region under the arch of the foot. A concentration of veins draining the foot is located in the soft tissues in region 25, located in front of the Achilles tendon. Thus, applying pressure at this point is very effective for increasing arterial blood flow. Because the bladder 26 contacts the inner ankle region, segment 27 will be positioned on either the right side or the left side of lower section 18 of the cast. Both versions can easily be provided, albeit in separate casts. The cast 12 surrounds only half the circumference of the leg and bottom of the foot, and the inflatable bladder 26 is smaller than the cast. The cast constrains the bladder against the leg. Because the volume capacity of bladder 26 is relatively small, very little pressure is required to inflate the bladder. Thus, high pressures, ranging from 80–160 mm Hg, can be attained almost instantly.

Figure 3:
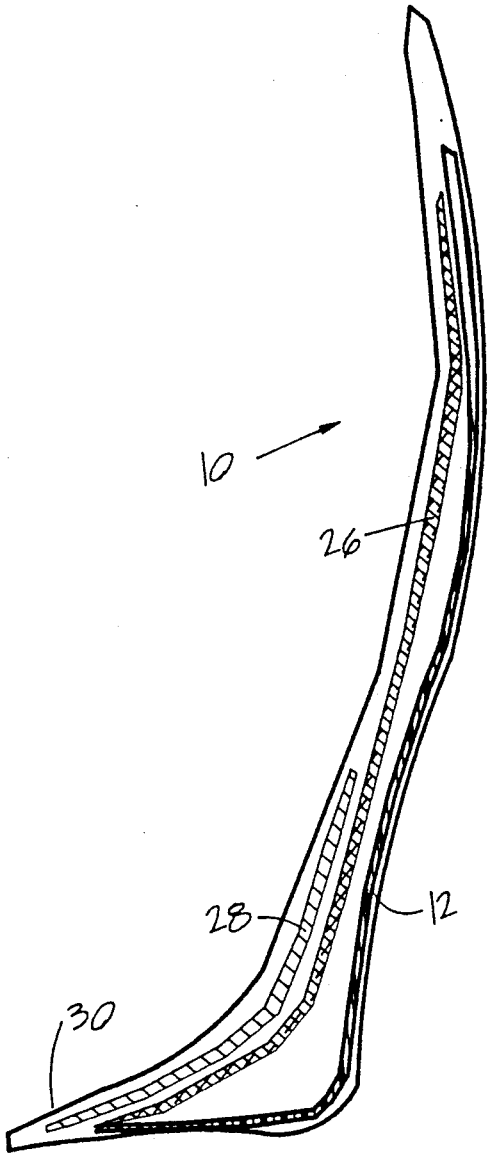
FIG. 3 is a longitudinal cross section through the compression boot layers, explaining its structure.

A heating pad 28 may optionally be provided to warm the skin of the foot to 30°–35 C. ° when room temperatures are low and skin circulation is poor. The function of the heating pad is to keep the veins in a relaxed state, by avoiding the venoconstriction, which exists in a cold environment. This results in a large vein diameter and volume. FIG. 3 shows the structure of the compression boot 10 in longitudinal cross-section. A fabric envelope 30, such as flannel or the like, surrounds cast 12 and provides ventilation for the skin. Heating pad 28 is located between bladder 26 and fabric envelope 30.

A large (approximately 3 mm internal diameter) air port 32 connects the bladder 26 to tubing 34, which is kept short and kink resistant. Tubing 34 connects the bladder to the inflation system, generally indicated by the reference numeral 36. Inflation systems for providing pressure to blood flow assist devices, such as those of the instant invention, are well known and are understood by those skilled in the art. An inflation system having a compressor output of 780 mm Hg (15 psi) would work well. Various types of electronic timers can be used for the pressure cycle and time delay. Thus, the time-pressure cycle can be preset and incorporated into the device, which facilitates its operation.

USE

Generally, venous emptying reduces the apparent peripheral resistance, which leads to an increase in arterial flow. Although in more severe cases of ischemia, the peripheral resistance is already low, the instant invention causes the further lowering of peripheral resistance by venous emptying. With the leg in a dependent position, it is possible to utilize gravitational potential energy present in the arterial blood to drive blood through the leg vasculature, along a pressure gradient, after reducing venous pressure to zero. In severe arterial obstruction, the flow distal to occlusions can be almost stagnant. After an initial compression with the boot, a hydrostatic pressure gradient builds up in the distal arteries. Subsequent compressions will exceed the hydrostatic pressure at first proximally in the arteries, proceeding distally. The effect of this is milking arterial blood towards the periphery.

The compression boot 10 of the instant invention is placed over and secured to the dependent lower leg of a sitting patient. Bladder 26 is rapidly inflated resulting in simultaneous compression of the soft tissues of the calf, ankle and foot, thereby completely and instantly emptying the veins, and reducing venous pressure to zero. Inflation system 36 is adjusted to deliver 80–100 mm Hg of pressure within 0.3–0.5 seconds. The high pressure range can be from 80–160 mm Hg, whatever is tolerable by the patient. This high level of pressure is sustained for an interval of 2–3 seconds, then the bladder is rapidly deflated to a pressure between 0–30 mm Hg. This low level of pressure is sustained for an interval of between 8–14 seconds. The cycle of alternating high pressure and low pressure is repeated over a 60–120 minute period. Other treatment applications of different time periods may be employed if necessary.

Figure 4:
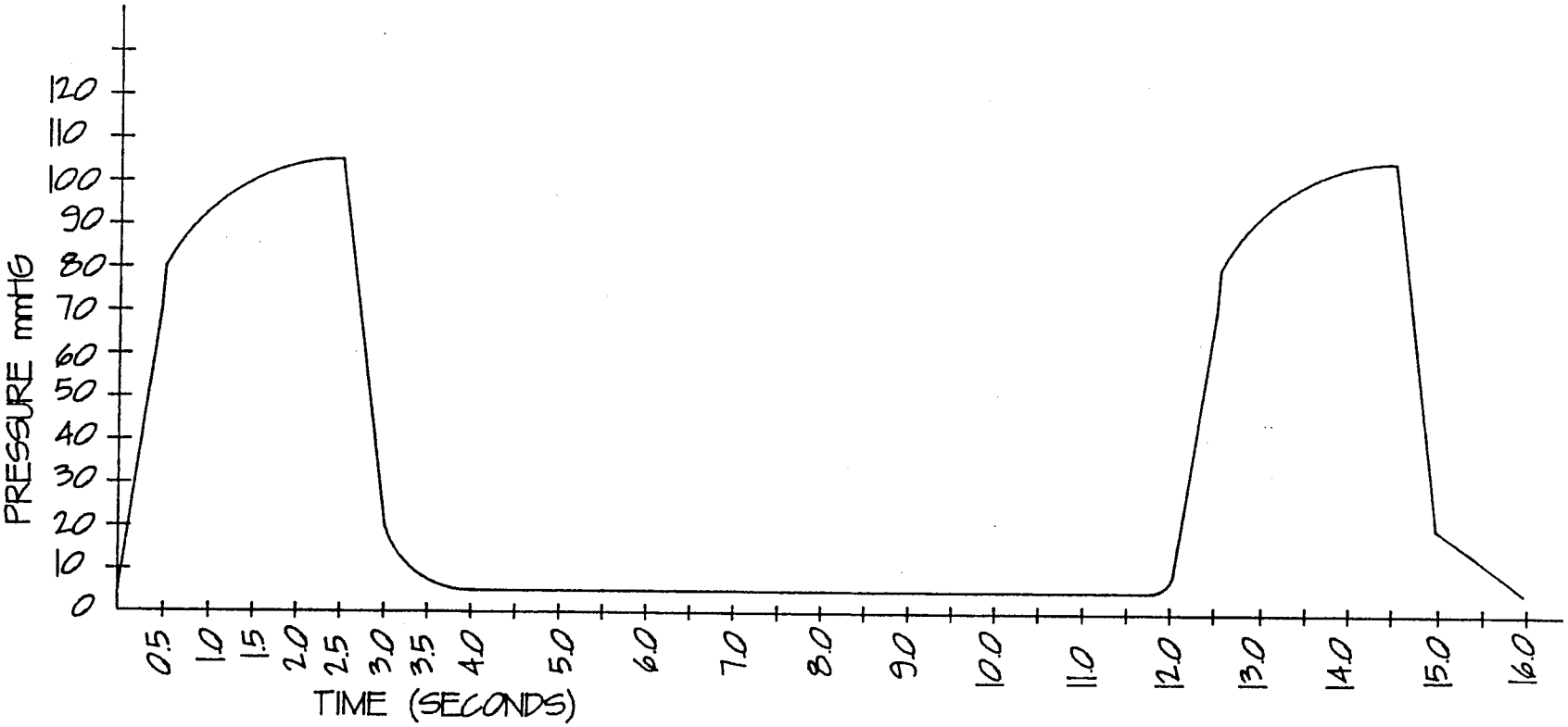
FIG. 4 is a graph showing the preferred fast rise time and decompression of the device, as well as the pressure in the various phases of the cycle.

FIG. 4 is a graph showing a preferred embodiment of the alternating pressure cycle over time. Optimally, a pressure of 80 mm Hg is attained within 0.5 seconds. Pressure is increased to 105 mm Hg over the next 2.5 seconds. Deflation to 0–20 mm Hg should occur within 0.5 seconds. The decompression period should last between 8–14 seconds.

Rapid inflation traps the arterial blood in the leg. No significant reverse flow occurs during the rapid inflation; rather, flow is arrested during that period. This leads to a smaller flow debt than that resulting from a gradual inflation, which may increase peripheral resistance which could cause a reverse arterial flow away from the foot. Flow debt is the difference between the amount of flow that would have occurred if the arterial circulation had been allowed to proceed uninterrupted, from the flow resulting during and after compression. Payment of the small flow debt occurs within the first two seconds after rapid inflation/deflation. Increase in arterial flow occurs over the next ten seconds in response to the increased arterio-venous pressure gradient from venous emptying. The greatest effects of increased arterial flow are seen between the third and tenth heartbeats of the patient, which span the 8–14 seconds decompression period. The overall increase in arterial flow, using the rapid cycle described by the invention, is nearly 250% during the time the compression boot is employed. The conversion of pulsatile blood flow into a more steady flow pattern reduces fluid-energy losses due to inertia. The resulting beneficial increase in blood flow is more than would be expected from the increased arterio-venous pressure difference alone.

Various changes and modifications may be made within this invention as will be apparent to those skilled in the art. Such changes and modifications are within the scope and teaching of this invention as defined in the claims appended hereto.

What is claimed is:

1. A device for applying pressure to a leg for improving arterial blood circulation, said device comprising a leg cast, an inflatable bladder, and means for inflating said bladder, said leg cast receiving the calf, foot and ankle of said leg, closure means being provided on said cast to secure said cast about said leg, said bladder being attached to an inside surface of said cast for restricted, non-circumferential engagement with specific regions of said leg, said regions comprising said calf, an inside face of said ankle behind the medial ankle bone and in front of the Achilles tendon and the heel bone, and an underside of said foot at the arch area thereof, whereby said bladder is inflated and constrained within said cast for applying pressure to said leg at said specific regions.

2. The device of claim 1 in which said means for inflating said bladder comprises a compressor, said compressor having tubing in fluid communication with said bladder, said compressor further having means for controlling the amount and duration of pressure delivered to said bladder, said bladder comprising a single compartment, whereby said specific regions of said leg are simultaneously compressed.

3. The device of claim 2 in which said compressor is capable of delivering a pressure of 80 mm Hg in 0.3–0.5 seconds to said specific regions of said leg simultaneously.

4. The device of claim 2 in which said compressor is capable of delivering a pressure of 105 mm Hg in 2.5 seconds to said specific regions of said leg simultaneously.

5. The device of claim 2 in which said compressor is capable of delivering pressure simultaneously to said specific regions of said leg in a first phase of 80 mm Hg in 0.3–0.5 seconds and a second phase of 105 mm Hg in 2.5 seconds.

6. The device of claim 5 in which means are provided for substantially completed decompressing said inflated bladder in 0.3–0.5 seconds.

7. The device of claim 1 in which heating means are provided in said cast for warming said ankle and foot to a temperature between 30°-35° C., whereby enlargement of the veins is stimulated for increased circulation, said heating means comprising a heating pad.

8. A method for improving arterial blood circulation to a leg, said method comprising applying high pressure at preselected intervals of short duration with rapid deflation, alternating with longer periods of decompression, to selected regions of said leg while said leg is in a dependent position, means for applying said pressure comprising an inflatable bladder positioned within a cast which is worn on said leg, inflating means located externally of said cast being provided for delivering pressure to said bladder, said high pressure having a range between 80-160 mm Hg, said high pressure being attained within 0.3-0.5 seconds and sustained for a duration of 2 seconds, said periods of decompression lasting between 5-14 seconds and having a pressure in the range between 0-30 mm Hg.

9. The method of claim 8 in which said selected regions of said leg include the calf, the soft tissues between the medial ankle bone and the heel bone, and the bottom surface of the arch of a foot.

10. The method of claim 8 in which a pressure of 80 mm Hg is reached in 0.5 seconds after initiation of a pressure cycle, and a further pressure of 105 mm Hg is reached within 2.5 seconds after said initiation, deflation of said bladder is effected within 0.5 seconds, and said period of decompression has a duration of 8-14 seconds at a pressure of 0-30 mm Hg.

11. The method of claim 8 in which heat is applied to said selected regions of said leg, whereby enlargement of veins in the vicinity of said areas is stimulated for increased circulation.

12. The method of claim 8 in which a pressure of 80 mm Hg is reached in 0.5 seconds after initiation of a pressure cycle, and a further 105 mm Hg is reached within 2.5 seconds after said initiation, deflation of said bladder is effected within 0.5 seconds, and said period of decompression has a duration of 8-14 seconds at a pressure of 0-30 mm Hg, and said selected regions of said leg include the calf, the soft tissues between the medial ankle bone and the heel bone, and the bottom surface of the arch of a foot.

13. The method of claim 8 in which a pressure of 80 mm Hg is reached in 0.5 seconds after initiation of a pressure cycle, and a further pressure of 105 mm Hg is reached within 2.5 seconds after said initiation, deflation of said bladder is effected within 0.5 seconds, and said period of decompression has a duration of 8-14 seconds at a pressure of 0-30 mm Hg, and said selected regions of said leg include the calf, the soft tissues between the medial ankle bone and the heel bone, and the bottom surface of the arch of a foot, and heat is applied to said selected regions of said leg, whereby enlargement of veins in the vicinity of said areas is stimulated for increased circulation.

* * * * *